US006431775B1

(12) United States Patent
Huang et al.

(10) Patent No.: US 6,431,775 B1
(45) Date of Patent: Aug. 13, 2002

(54) AUTOMATIC PRINT CARTRIDGE ALIGNMENT SYSTEM

(75) Inventors: Ruei-Lon Huang, Hsin Chu; Shu Cheng Hsieh, Hsin Chu Shi, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 08/657,153

(22) Filed: Jun. 3, 1996

Related U.S. Application Data

(63) Continuation of application No. 08/527,325, filed on Sep. 12, 1995, now abandoned.

(51) Int. Cl.[7] ..... B41J 19/30

(52) U.S. Cl. ..... 400/323; 400/322; 400/283; 347/19

(58) Field of Search ..... 400/323, 322, 400/321, 320, 319, 283; 347/19, 37, 107

(56) References Cited

U.S. PATENT DOCUMENTS 4,345,263 A * 8/1982 Tazaki et al. ..... 400/323
4,818,129 A * 4/1989 Tanuma et al. ..... 400/323
4,971,464 A * 11/1990 Shikanai ..... 400/323

* cited by examiner

*Primary Examiner*—Andrew H. Hirshfeld
*Assistant Examiner*—Minh Chau
(74) *Attorney, Agent, or Firm*—H. C. Lin

(57) ABSTRACT

An automatic alignment system is used to correct the offset error of a bidirectional printing device. The positional offset between the forward printing and the backward printing is compensated by adjusting the position of the printing cartridge. The actual position of the cartridge is sensed by a light detector, which is shuttered when the moving cartridge, driven by a microstepping motor, passes through the sensor. Based on the difference between the actual position and the correct theoretical position, the cartridge position is automatically adjusted to correct the offset error. For fine adjustment, time delay can be used in addition to the positional adjustment of the cartridge.

12 Claims, 7 Drawing Sheets

AUTOMATIC PRINT CARTRIDGE ALIGNMENT SYSTEM

This application is a continuation-in-part, of application Ser. No. 08/527,325, filed Sep. 12, 1995, now abandoned.

This invention relates to automatic print cartridge alignment system to correct the positional offset of the cartridge of a bidirectional printing device.

BACKGROUND OF THE INVENTION

There are several known methods for compensating the errors of a cartridge. A traditional method is for a user to view a test pattern and to adjust for the best printout. The adjustment is then set. This method has been disclosed in U.S. Pat. No. 4,818,129 and Japanese patent No. 61-76372, where correction have been preset in the cartridge and no automatic correction capability are provided. Another method has been disclosed in U.S. Pat. No. 5,044,796 (Republic of China patent No. 151002), which first analyzes the content to be printed and then determines the best adjustment for least amount of offset for the bidirectional printing. Although this method can increase the throughput, it also does not have the capability of automatic compensation, and is suitable only for sparse printing content. For dense printing content, this method only has the unidirectional printing capability. Still another method, as disclosed in U.S. Pat. Nos. 5,289,208, 5,250956 and Japanese patent 62-227757, relies on actual printing to detect the actual amount of offset. The offset sensing system utilizes an analog-to-digital converter and an amplifier, together with light source and lenses. The sensing circuit is relatively expensive. Furthermore, since actual printing of a test pattern is required to determine the offset, the method is not suitable for manufacturing production.

Tazaki disclosed in U.S. Pat. No. 4,345,263 a print carriage, which uses a linear motor and an optical ruler to feedback and determine the position of the print cartridge. Due to limitations of the optical ruler and its sensor, the accuracy of the system is limited. The best resolution which Tazaki's system can achieve is the pitch between the slots of the optical ruler.

Tanuma disclosed in U.S. Pat. No. 4,818,129 a print cartridge, which is incapable of automatically detecting the offset between two opposite directions of printing. Two rows of test patterns of vertical lines orthogonal. to the movement of the carriage must be scanned. The first row is for forward scan, and the second row is for reverse scan. Time delay or advance is introduced manually to align the corresponding vertical lines in the two rows. The required time delay or advance for correction of each pair of vertical lines is stored in a wire matrix. The alignment is done by user's eye and therfore not automatic.

SUMMARY

An object of this invention is to provide a method and system for automatic alignment of cartridge for bidirectional printing. Another object of this invention is to increase the operating speed of bidirectional printing. Still another object of this invention is to provide automatic alignment of cartridge during manufacturing without actual printing a test pattern. A further object of this invention is to provide an automatic cartridge alignment system for bidirectional printing, which is low-cost, highly accurate, simple in structure and suitable for mass production.

These objects are achieved in this invention by sensing the actual position of the printing cartridge with respect to its theoretical position. The required compensation for corrrecting the offset error is then calculated and used to control the printing cartridge. For finer control, time delay may be used in addition to adjusting the position of the cartridge.

BRIEF DESCRIPTION OF THE DRAWINGS

FIG. 2(*b*) shows the structure of the sensor where the circuit of FIG. 2(*a*) is enclosed.

DETAILED DESCRIPTION OF THE PREFERRED EMBODIMENT

In a bidirectional printing device, the method to automatically compensate for positional offset error in a bidirectional printing device comprises two functions, namely: the sensing of the offset and the compensation of the offset. The accuracy with which the offset is measured affects the compensation result and must be provided in an automatic compensation scheme. Thus, it is desirable that the sensing scheme (i.e. the sensing device and the sensing circuit) be cost effective, highly reliable, simple in structure, suitable for automatic compensation for different degrees of offset in different printers without human judgement, and adaptable for mass production.

For offset compensation, this invention adopts appropriate offset information for adjusting the position of the cartridge and delay printing to accomplish the object. These two mechanisms combine high speed and accuracy for minute offset compensation. Firmware is used to reduce the hardware cost and circuit complexity.

Figure 1:
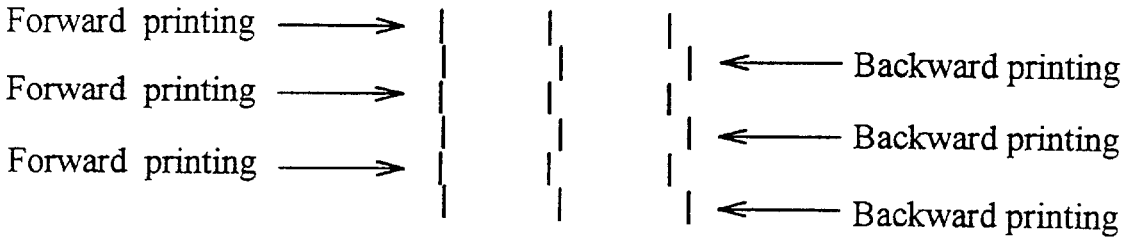
FIG. 1 illustrates the offset phenomenon produced by a cartridge of a bidirectional printing device.

The advantages of the present invention are as follows: Bidirectional printing refers to a printing system in which one or more cartridges can print on a medium (such as paper) with a bidirectional forward and backward motion. Due to the backlash of the driving mechanism such as a belt or a gear, the stiffness performance and the hysteresis error of the driving motor, and mechanical vibration, the cartridge may reproduce a bidirectional print with offset error as shown in FIG. 1. Such an offset error gravely affects the quality of the reproduction. This offset error is especially pronounced for documents containing figures or perpendicular lines.

Figure 2:
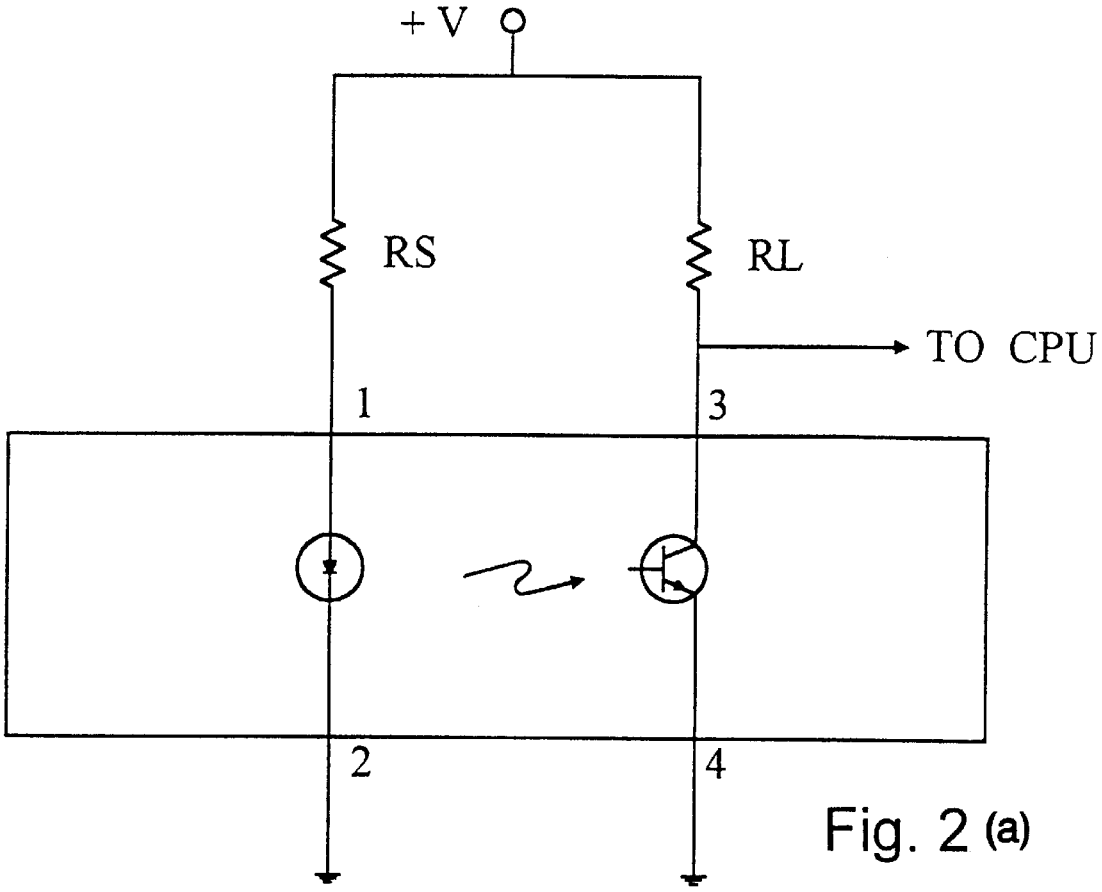
FIG. 2(*a*) shows the circuit for sensing the offset error based on the present invention.
Figure 2:
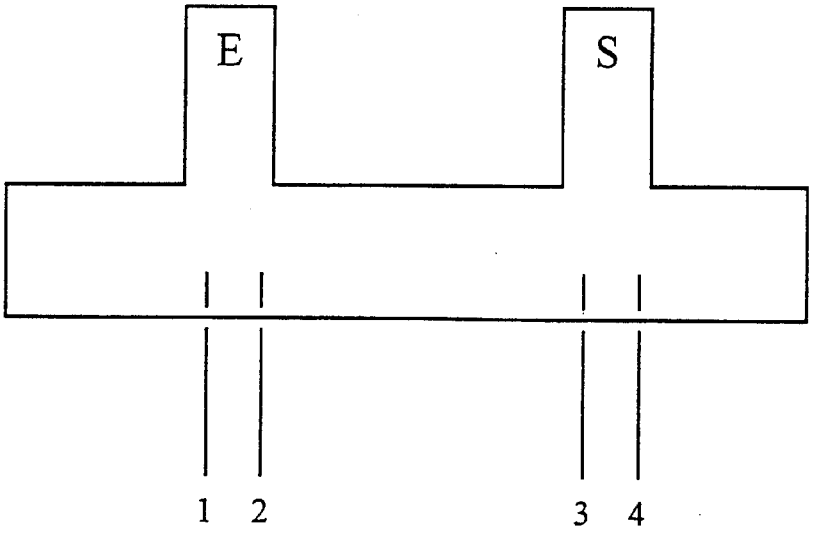

FIG. 2(*a*) shows the electric circuit for sensing the offset error in this invention. In this circuit, a light emitting diode D is connected between terminals 1 and 2, where terminal 1 is connected through a resistor RS to a positive power supply +V and terminal 2 is connected to a negative power supply or ground. A photo-transistor T is connected between terminals 3 and 4, where terminal 3 connects the collector C through a resistor RL to +V and terminal 4 connects the emitter E to ground. An output signal is obtained at the collector C of the photo-transistor. The sensor unit 51, where the sensing circuit is located, is shown in FIG. 2(*b*) and is mounted in the path of the moving printing cartridge. A shutter is mounted in the cartridge, which blocks the light from the diode to the photo-transistor when the cartridge scans past the sensor. Then, the photo-transistor is off and the output voltage at C is pulled up. This output voltage is connected to a microprocessor and indicates the actual position of the cartridge. This sensing circuit requires only two resistors and does not require any expensive A/D converters, amplifiers or phase-lock loops to process the signal.

Figure 3:
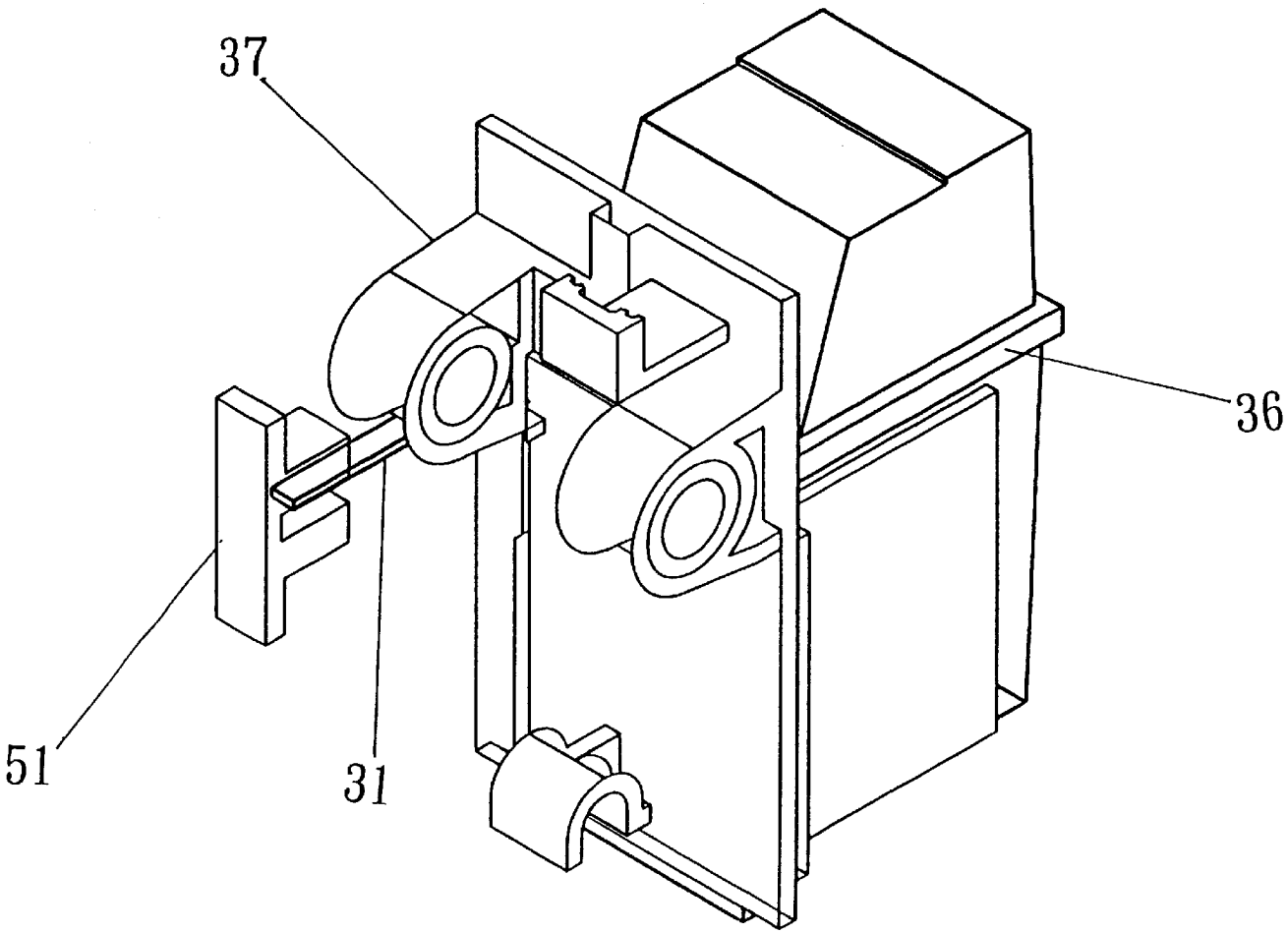
FIG. 3 shows the construction of the cartridge carriage based on the present invention.
Figure 4:
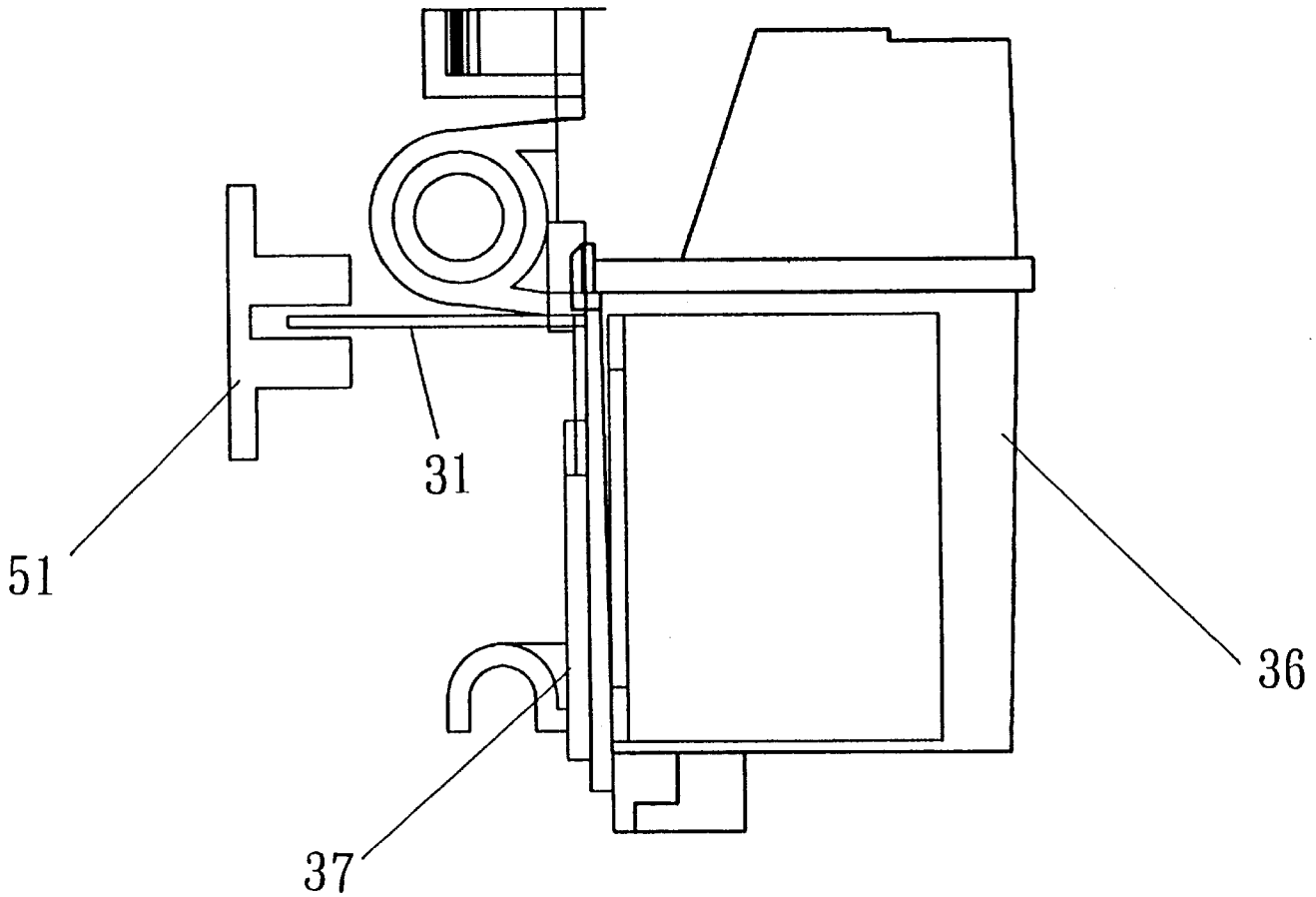
FIG. 4 shows the side-view of the cartridge as it passes through a light senser.

FIG. 3 and FIG. 4 show the method of the present invention to sense the positional offset. A shutter (sensing arm) 31 is attached to the carriage 37 of a cartridge 36. When the light senser 51 senses the sensing arm during the cartridge moving forward and backward, a feedback signal is fed to the microprocessor for calculating the offset between theoretical and actual positions. This method is an improvement over the traditional method of actually printing out a test pattern, from which the positional offset is sensed. The method is simple and speedy, and can be implemented even without any paper in the paper tray. Therefore, it is suitable for mass production. In practice, automatic compensation is provided from the beginning of every page or at every motion of the cartridge.

Figure 5:
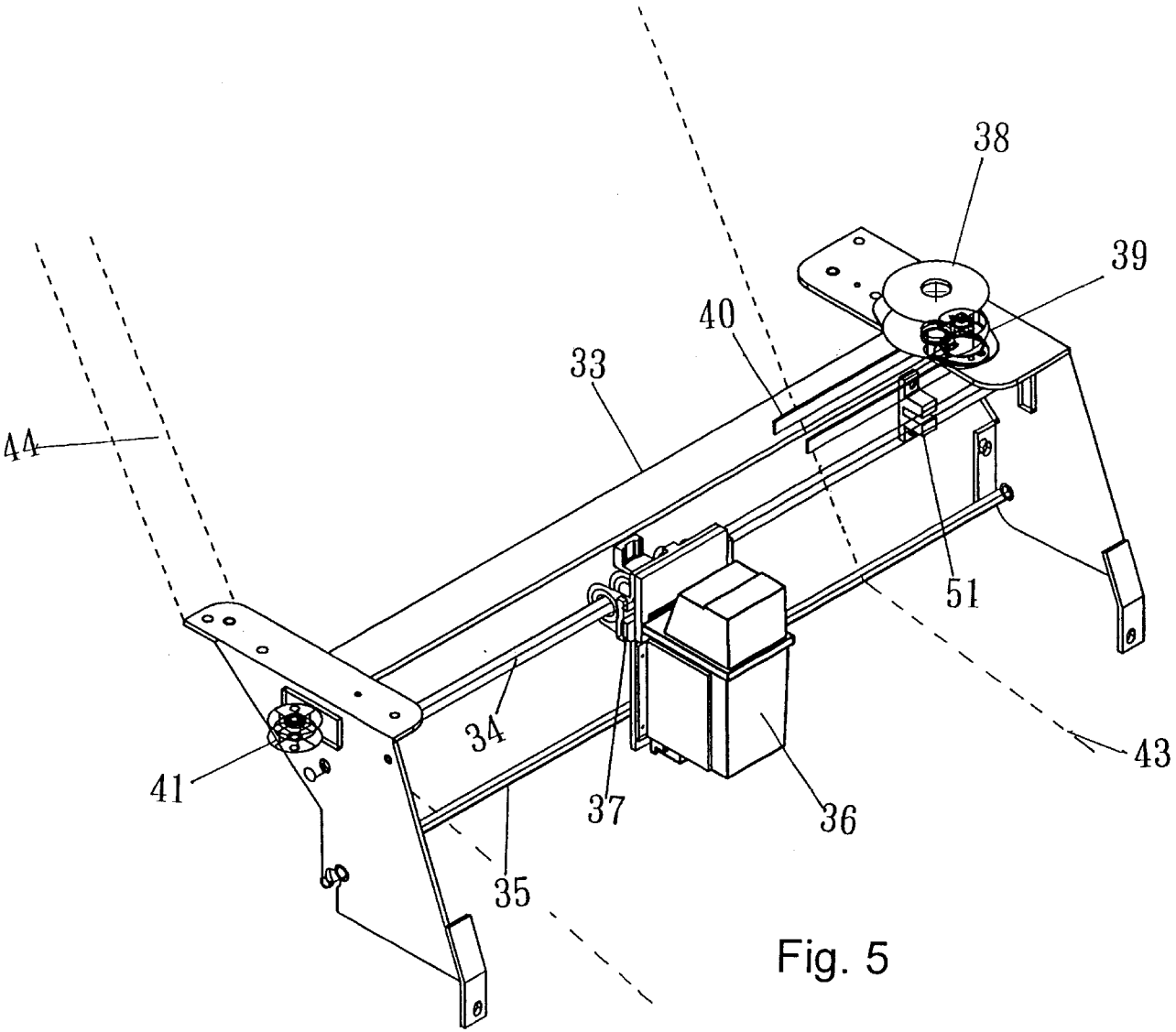
FIG. 5 shows how the cartridge is mounted on a printer.

FIG. 5 shows how the cartridge of the present invention is mounted on a printing device. The upper section 33 contains the moving mechanism for the cartridge carriage (such as the printer frame, paper transfer mechanism, gear transmission system, etc. not shown). The cartridge 36 and the carriage is driven by a motor 38 through a timing belt 40 and wheels 39,41 along two rods 34, 35 to guide the bidirectional motion of the cartridge 36. The space between the dotted lines 44 represents the position of the cartridge before printing, and the space between the dotted lines 43 represents the forward position of the cartridge after printing. The motor 38 has a microstepping characteristic, which is capable of subdividing each optically measurable step into 16, 64 or more microsteps by time division. While microstepping, the carriage moves slowly and measures the exact microstep for the shutter to shut off the light of the sensor. The microstep information is stored in a memory. After computation, the stored information can provide automatically the corrected position of the printer carriage. Thus this invention provides a higher degree of accuracy and labor saving than prior art.

Figure 6:
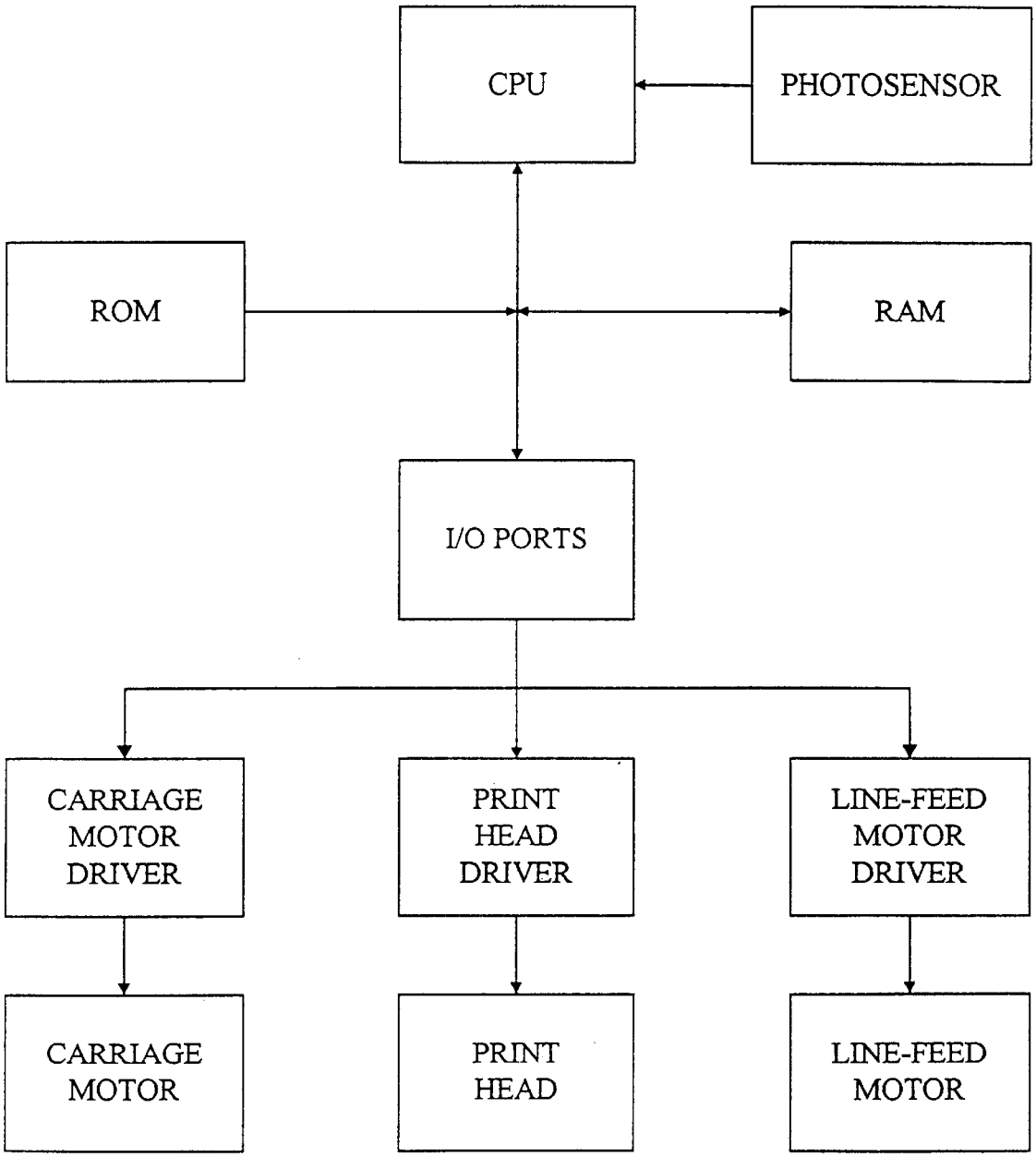
FIG. 6 shows the block diagram of the control unit based on the present invention.

FIG. 6 shows the block diagram of print control function. When the light detector senses the actual position of the forward and backward motion, the actual position of the cartridge is fed to the microprocessor. The microprocessor uses the formula stored in the Read-only memory (ROM) to accurately calculate the positional offset of the bidirectional printing device. In a separate Random Access Memory (RAM), the processing data during the calculation are stored. After the actual offset value is calculated, the number is converted into correction value and outputted through the I/O port to drive the motor to the correct position for printing. If the correction value is smaller than the minimum dot pitch of the printing device, the printing time is delayed to obtain a finer correction.

Figure 7:
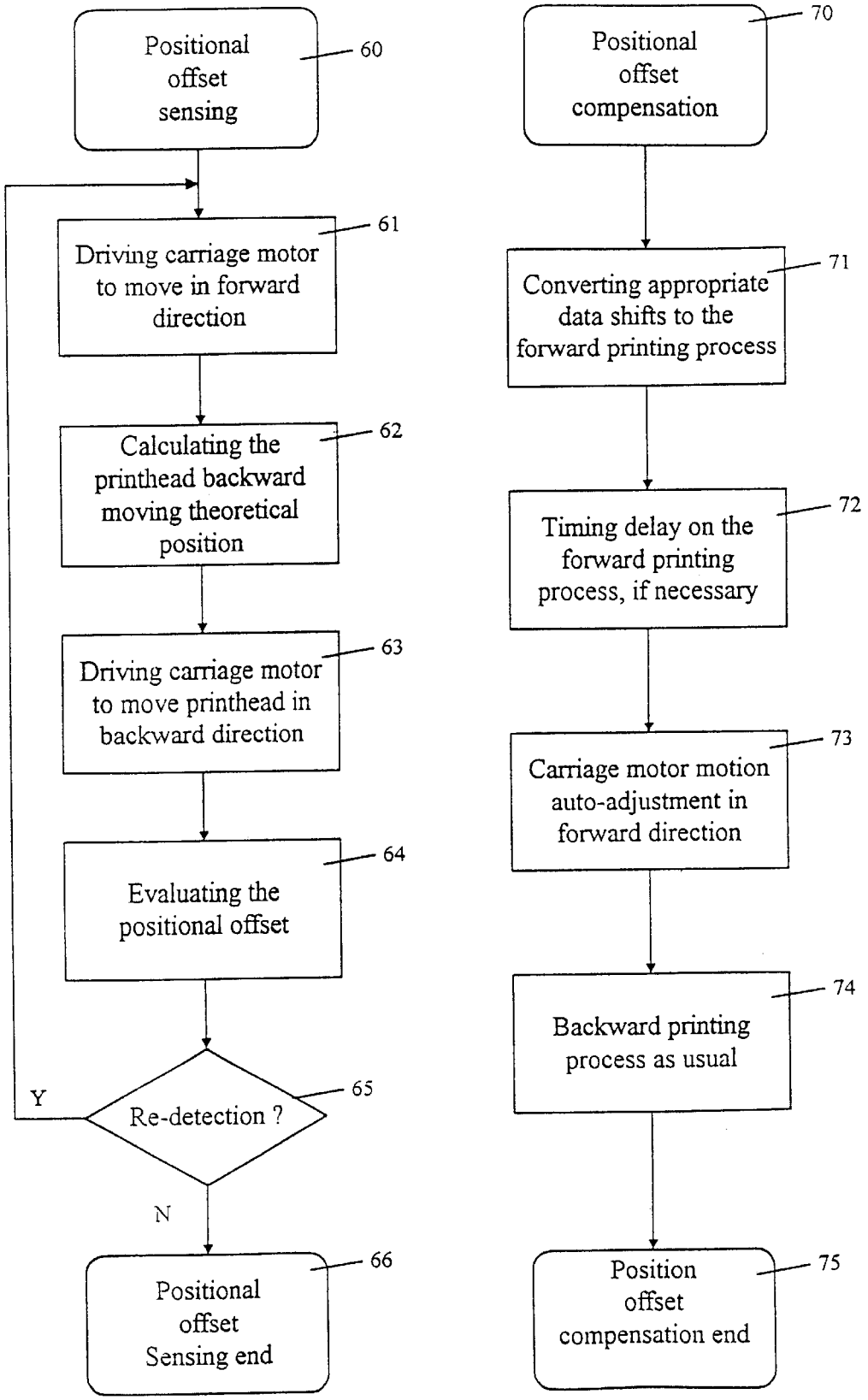
FIG. 7 shows the flow-chart of the control procedure based on the present invention.

FIG. 7 shows the flow chart of the present invention for automatic correction of the positional offset. The flow can be divided into a positional sensing section 60 and a positional compensating section 70.

I. The Sensing Section Steps

Step 61: The motor drives the cartridge carriage 37 in the forward direction.

Step 62: The firmware uses the feedback signal from the light sensor to calculate the theoretical position when the cartridge moves in the backward direction.

Step 63: The motor drives the cartridge carriage 37 in the backward direction.

Step 64: Using the feedback signal obtained from the sensor, the actual positional offset of the cartridge is calculated.

Step 65: If the calculated offset value exceeds a predetermined value or if there is no offset, step 60 is repeated. If the number of repetition reaches the system limit, an error signal is generated and the cartridge frame is reset to its home position, where the cartridge is positioned before any compensation.

Step 66: The offset sensing is completed.

II. Compensation Section Steps

Step 71: Before the forward printing program, the magnitude of the offset calculated from Section I is converted into data shifts for positional offset compensation (in terms of a starting pointer in the corrected printing data).

Step 72: If the converted offset value is smaller than the dot pitch of the printing device, the forward motion printing time is delayed for automatic compensating correction.

Step 73: Based on the position compensating correction, appropriate motion is exercised by the motor.

Step 74: In the backward motion, no compensating correction is used.

Step 75: The birectional printing and compensating correction are complete.

While the foregoing system is described using a light sensor to detect offset, it is possible to use other forms of electromagnetic radiation, such as radio frequency, magnetic field, etc. to accomplish the same offset error correction. The relative positions of the shutter and the sensor can be changed or exchanged to perform the same function. These variations are all within the scope of this invention.

What is claimed is:

1. An automatic offset error correction system for a bidirectional printing device, comprising:

a bidirectional printer having a cartridge mounted on a movable carriage, which is driven by a microstepping motor to glide along tracks and to print on media beneath the cartridge in both a forward direction and a backward direction, said microstepping motor having a microstepping characteristic, which subdivides individual optically measurable steps into multiple microsteps with time division, a sensor having a radiation source and a radiation detector to sense the actual position of the cartridge corresponding to one of said microsteps during printing in both said forward direction and said backward direction, a shutter, which blocks the radiation from said source to said detector when the shutter glides past the sensor, a print controller, which receives the signal from said sensor, calculates positional offset between printing in the forward direction and printing in the backward direction, and controls the microstepping motor to automatically adjust the cartridge to compensate said position offset during printing.

2. An automatic offset error correction system as described in claim 1, wherein said sensor is a light sensor, said radiation source is a light source, and said detector is a light detector.

3. An automatic offset error correction system as described in claim 2, wherein said sensor is mounted in a fixed position on said printing device.

4. An automatic offset error correction system as described in claim 3, wherein said shutter is mounted on the cartridge.

5. An automatic offset error correction system as described in claim 2, wherein said sensor is mounted in said cartridge.

6. An automatic offset error correction system as described in claim 5, wherein said shutter is mounted in a fixed position on the printing device.

7. An automatic offset error correction system as described in claim 2, wherein said sensor and said shutter are placed within the borders of said media.

8. An automatic offset error correction system as described in claim 2, wherein said light source is a light emitting diode and said light detector is a photo-transistor.

9. A method of automatically correcting offset printing error in a bidirectional printing devide, comprising the steps of:

sensing the actual position of the cartridge of said printing device, wherein the position is determined by a microstepping motor, which subdivides individual optically measurable step into multiple microsteps with time division, calculating the difference between said actual position and theoretically data shifts of said cartridge, converting said difference into corresponding position whereby appropriate forward motion adjustment is made of said cartridge to compensate the offset error between forward printing and backward printing of said bidirectional printing device.

10. A method of automatically correcting offset printing error in a bidirectional printing device as described in claim 9, wherein said step of converting said difference is refined by delaying printing time to further compensate the offset error between said forward printing and said backward printing.

11. A method of automatically correcting offset printing error in a bidirectional printing device as described in claim 10, wherein said delaying printing time is used when said printing error is less than the dot pitch of the printing device.

12. A method of automatically correcting offset printing error in a bidirectional printing device as described in claim 9, wherein said step of calculating includes calculating the correct data shifts for positional offset compensation in terms of a starting pointer in the corrected printing data.

* * * * *